United States Patent [19]

Cavagna

[11] Patent Number: 4,905,554

[45] Date of Patent: Mar. 6, 1990

[54] CUTTER FOR USE IN PAPER MANUFACTURING

[75] Inventor: Elio Cavagna, Milan, Italy

[73] Assignee: Elio Cavagna s.r.l., Milan, Italy

[21] Appl. No.: 170,657

[22] Filed: Mar. 18, 1988

Related U.S. Application Data

[63] Continuation of Ser. No. 838,682, Mar. 12, 1986, abandoned, Continuation-in-part of Ser. No. 545,968, Oct. 27, 1983, abandoned.

[51] Int. Cl.[4] ..... B26D 1/24

[52] U.S. Cl. ..... 83/482; 83/501; 83/504

[58] Field of Search ..... 83/482, 498–504, 83/505–507

[56] References Cited

U.S. PATENT DOCUMENTS

| | | | |
|---|---|---|---|
| 3,041,907 | 7/1962 | Gallagher, Jr. | 83/504 X |
| 3,185,010 | 5/1965 | Printz et al. | 83/482 |
| 3,186,281 | 6/1965 | Wingen | 83/482 X |
| 3,186,282 | 6/1965 | Waterhouse | 83/497 |
| 3,511,123 | 5/1970 | Smith | 83/482 |
| 3,877,335 | 4/1975 | Lange | 83/501 |
| 3,892,156 | 7/1975 | Johnstone | 83/482 X |
| 4,434,695 | 3/1984 | Wingen | 83/502 X |
| 4,438,673 | 3/1984 | Noffke | 83/502 |
| 4,474,096 | 10/1984 | Muller | 83/502 X |
| 4,540,394 | 9/1985 | Cavagna | 83/499 |

FOREIGN PATENT DOCUMENTS

| | | | |
|---|---|---|---|
| 2072563 | 10/1981 | United Kingdom | 83/498 |

*Primary Examiner*—Hien H. Phan
*Assistant Examiner*—Eugenia A. Jones
*Attorney, Agent, or Firm*—Collard, Roe & Galgano

[57] ABSTRACT

An improvement in cutters used in the field of paper manufacturing consisting in that the support-bearing for the knife is connected to a raising and lowering device through a structure elastically deformable and able to impart elastically opposing movements to the knife. These movements are essentially motions of torsion which allow compound movements thereby providing continuous engagement between the knives and the counter knives during rotation. Said elastic structure consists of at least one rectangularly shaped elongated blade formed of steel.

6 Claims, 2 Drawing Sheets

CUTTER FOR USE IN PAPER MANUFACTURING

REFERENCE TO RELATED APPLICATIONS

This is a continuation application of application Ser. No. 838,682, filed Mar. 12, 1986, now abandoned, which in turn is a continuation-in-part application of Ser. No. 545,968, filed Oct. 27, 1983, now abandoned.

FIELD OF THE INVENTION

The present invention relates to an improvement in cutters used industrially in the field of paper manufacturing. More particularly, the present invention relates to an improvement in locking and/or releasing means structurally and operatively associated with supports for circular rotating knives for cutters used industrially in the field of paper manufacturing.

DESCRIPTION OF THE PRIOR ART

As known, the cutters are utilized for the continuous removal of strips or other components taken from essentially laminar material, such as paper, cardboard, sheets of polymer material, etc.

In the known cutters, cutting is done by circular knives rotating rapidly about an axis, which, in general, is held directionally stationary in space, in cooperation with a counter support or anvil in opposition to the knives which in turn rotate and are generally motorized so as to transmit the rotation to the cooperating knife.

The equipment includes several structural and operative units, each of which comprises at least one first support co-operating with sliding and translation means along at least one bearing beam, raising and lowering means for the circular knife and selective lock and release means for said first support on the beam or guides.

In my earlier filed application U.S. Ser. No. 462,880 filed on Feb. 1, 1983, now U.S. Pat. No. 4,540,394, an improved selective lock and release means is disclosed. The disclosed lock and release means is coordinated and organized so that the raising and lowering motions of the cutting elements coincided with the actuation of the means for locking and repeated releasing, using a fluid under pressure, preferably but not necessarily air, supplied by a single circuit system. A further provision is the fact that the single circuit system comprised a primary feed line and a plurality of branch conduits leading to the individual cutting elements, these branch conduits being flexible in order to allow even individual movements of said elements along said beam.

The cutting units are constructed so as to allow individual inversion and positional variations of said units along the beam, and for the movements along said beam, each unit comprises an electric motor mounted on a plate and including a pinion passing through said plate and engaged in a rack fixed to the sliding and guiding means.

The branch conduits are subdivided in at least one lowering and raising actuator, the subdivision being carried out in a valve device comprising a self-regulating valve.

In the cutting assembly described in the above my application the locking piston is arranged and operated in a chamber formed in the stationary component in the respective structural unit.

SUMMARY OF THE INVENTION

The present invention concerns a further improvement in the locking and/or releasing systems. In its broadest scope, the present invention provides an improvement consisting in that the support, by which the circular knife is held in rotation, is connected to said lowering and raising means through a structure elastically deformable in space, thereby able to impart to the knife elastically opposite movements.

According to an important characteristic of this invention, said support can be strained under bending stress and/or torsional stress.

The structure of the present invention allows composite movements of said knife with respect to the operative components associated therewith. In the present improved system, said composite movements result from the combination of elastic torsional and bending deformations of the elastical structure.

In accordance with the present invention, said structure is advantageously actuated by at least one metal blade (which can be a plurality of blades juxtaposed and fastened together), generally rectangular in shape and elongated, sized sufficiently to allow an elastic deformation under torsion. Said blade, or plurality of blades, is preferably made of steel. The support, by which the circular knife is held in rotation, comprises means for moving said knife in a direction parallel to its axis of rotation. This means includes components relatively movable under action of a fluid under pressure, i.e. a cylinder, a piston and a spring.

The present invention will be described and understood more readily when considered together with the accompanying drawing in which:

DESCRIPTION OF THE PREFERRED EMBODIMENT

Figure 1:
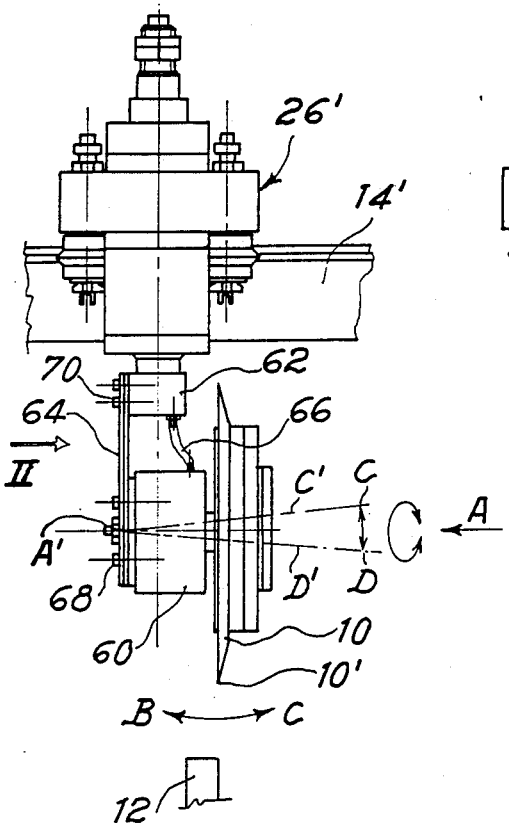
FIG. 1 is a schematic side view of the assembly or operative unit according to the present invention.

With reference to the drawings there is shown a rotary knife, designated 10, intended to cooperate with the counter support or anvil, designated 12, which is shown distant from the knife 10, while the direction arrow A in FIG. 1 indicates the track of the plane in which the laminar material (paper, cardboard, plastic material or the like) is advanced. The stationary structure, designated 14', forms the guide bearing the sliding group 26' beneath which is arranged knife support 60.

Figure 5:
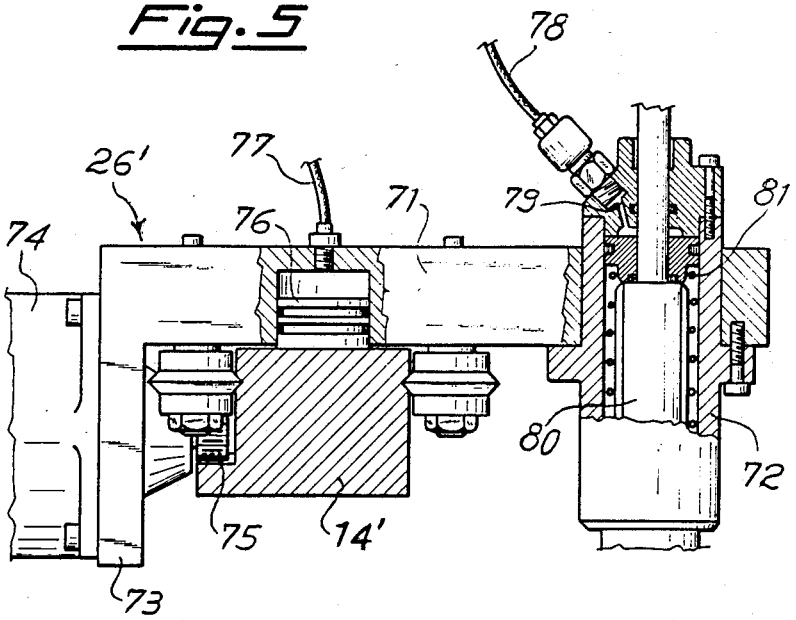
FIG. 5 represents some components partially in view and partially in section of the operative structural unit shown in FIG. 2.

With particular reference to FIG. 5, the sliding group 26' comprises a plate 71 having an "L" shape. This plate comprises a longer arm 71 in which is pitched and fixed the hub 72 of the actuator 80 elastically returned for lowering and lifting the corresponding knife 10, and a second arm 73 bearing a motor 74, generally electrical, which operates a toothed pinion which engages itself on a rack 75 toothing of which belongs to the guide 14'. A piston 76, operating in a chamber formed in the plate 71 under the action (pressure or depression) of a fluid fed by a circuit means 77, constitutes the actuator of the lock and, respectively, of the release. A second fluid circuit means 78 feeds in 79 the actuator 80 for lowering the knife 10; while an elastic means, such as spring 81, draws the knife 10 in the raised position; thereby the respective movements of approach to and removal from counter support or anvil 12 is imparted to knife 10.

Both the circuit means 77 and 78 may be started through only one feeding line so that the lowering of knife 10 by activator 80 and raising by spring 81 are coordinated to coincide with the locking and releasing of sliding group 26' on structure 14', respectively.

A component 62 is fastened to actuator 80 of the sliding group 26' and said component 62 is connected to the knife support 60.

The knife support 60 comprises means for moving knife 10 in a direction parallel to its axis of rotation via fluid pressure. The knife moving means comprises a pneumatic cylinder 61 formed in the support 60 and provided with a piston rod 63, having an enlarged end. The knife disc 10 is mounted by means of roller bearings 69 on the non enlarged portion of piston rod 63 so as to be freely rotatable on an axle which is formed by said piston rod 63. The connection between the knife disc 10 and piston rod 63 is assured by a screw provided with a lock nut 67.

Pressurized fluid deriving from the circuit means 78, through a sequence of passages, provided in actuator 80 and in component 62, (not illustrated in the figures) and through a flexible tube 66, reaches the cylinder 61 and acts on the enlarged end of piston rod 63 moving it in a position of approach to counter support or anvil 12. The movement of the assembly including piston rod 63 carrying the blade 10 is opposed by any return means, preferably elastic, such as a spring 65. Thus, knife 10 is axially moved toward anvil 12 and away therefrom coincidentally with the lowering and raising of the knife by actuator 80 and spring 81, respectively, and the locking and releasing of sliding group 26' on structure 14', respectively.

Figure 2:
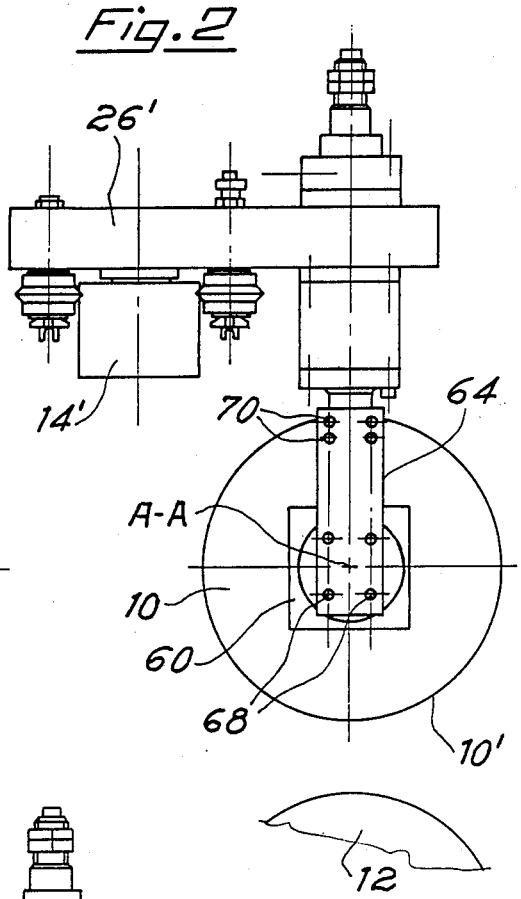
FIG. 2 is a view as seen from the direction arrow II of FIG. 1 of the assembly according to the present invention.

The connection between component 62 and knife support 60 is the main feature of the present invention. According to the present invention, this connection is carried out by means of the elastically deformable intermediate support, designated 64, which can be advantageously formed of two or more (see FIG. 1) rectangularly shaped, elongated blades, as seen in FIG. 2. The blades are preferably formed of steel.

The elastic flexibility of the elastically deformable support 64 makes it possible, first of all, for the support-bearing 60 to move in space in the directions indicated by B and C in FIG. 1 due to the bending of support 64.

The characteristic torsional deformability of support 64 allows support-bearing 60 to perform composite movements, by the effect of which the real axis of rotation of knife 10 (the axis whose intermediate position coincides with the track A of FIG. 1 and passes through point A-A of FIG. 2) performs, even so small, movements in addition to the bending movements B and C. Such movements are identified by the field C-D which is obviously projected in the plane of the drawing. By the effect of said movements, the axis of rotation of the knife moves between the values C' and D', the directions of said axis converging in such case at A', thereby defining the vertex of the three-dimensional cone generated by C' and D', with its axis at A.

Thus, the torsional and bending deformability in every direction, in the various planes of space, of the elastically deformable support 64 guarantees the constant adaptation of knife 10 to counter support or anvil 12. In addition, deformable support 4 absorbs any localized deformations of cutting edge 10 of knife 10, assuring the perfect execution of the operation of cutting and removing the material even under the most difficult conditions of cutting resistance, for example in the case of plastified polymer materials, and in other situations well known to one skilled in the art.

A flexible small tube 66 (see FIGS. 1 and 3), which does not hinder the movements of the support 60, even if composite, assures the communication between support 60 and component 62, and, therefore, the continuity of the fluid circuits. Such tube 66 is preferably made of an elastomer material.

Figure 3:
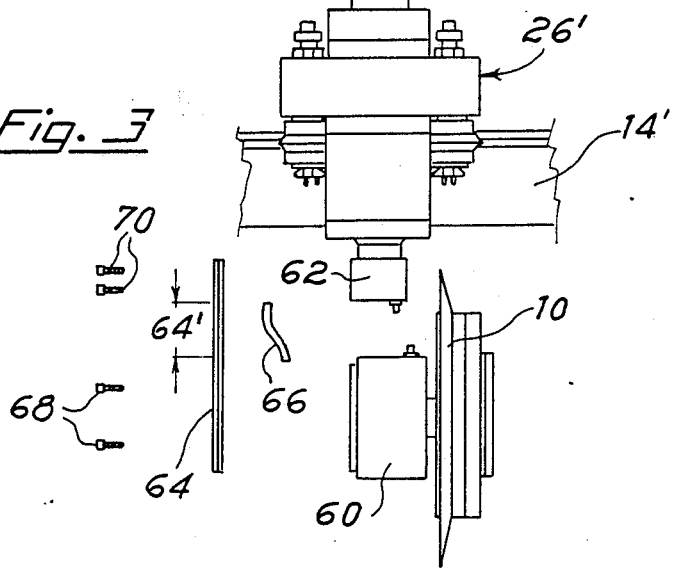
FIG. 3 is an exploded view of the assembly shown in FIG. 1.
Figure 4:
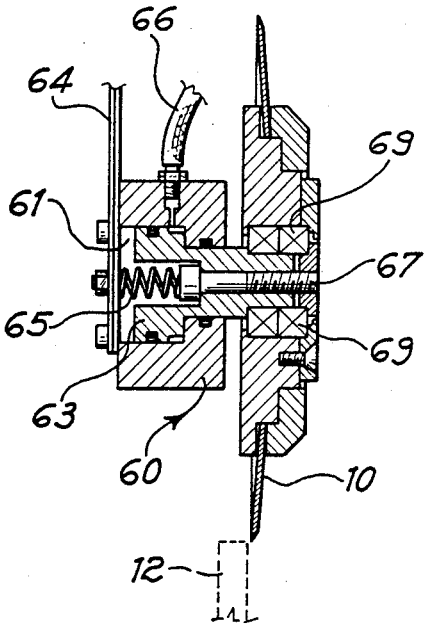
FIG. 4 is the section view of the knife support of the assembly shown in FIG. 1.

As can be seen in detail in FIGS. 1 and 3, elastically deformable support 64 is fixed rigidly at its ends to components 62 and, respectively, to support-bearing 60 by a plurality, for example four, of bolts 68 and 70, between which is comprised intermediate section 64' of support 64, in which the elastic torsional deformation occurs.

In any event, since the improved system has been described and presented merely as an illustrative but not limiting example, exclusively for the purpose of demonstrating a concrete embodiment of the system in question, it is evident that such system can be industrially produced and exploited in many variations, depending on the most diverse needs and requirements of application and association with different systems, and also for diverse industrial applications. Therefore, variations, modifications and changes may be made to the present system, without departing from the scope of the present invention, as defined in the following claims.

What is claimed is:

1. In a cutter for use in paper manufacturing comprising an operative structural unit having at least one support cooperating with a sliding and translation means, a bearing beam, guides for the translation of said operative unit along said bearing beam, said operative unit including means for selectively locking and unlocking said support on said beam, a circular knife, a support for rotatingly supporting said knife, means for lowering and raising said knife support, and means for synchronizing the lowering and raising means for the circular knife and the means for locking and unlocking said support on said beam so that simultaneously with the lowering of said knife support said support cooperating with said sliding and translation means locks with respect to said beam and simultaneously with the raising of said knife support said support cooperating with said sliding and translation means unlocks with respect to said beam, and a counter-knife, the improvements comprising:

means included with said knife support for moving said knife in a direction parallel to the axis of rotation of said knife;

an elastically deformable means connecting said knife support to said means for lowering and raising said knife support; and means operatively connecting the means for lowering and raising said knife support to the means for moving said knife in a direction parallel to the axis of rotation of said knife so that simultaneously with the lowering of the knife support and the locking of the support on the beam, said knife approaches the counter-knife, and simultaneously with the raising of the knife support and the releasing of the support from the beam, said knife departs from the counter-knife.

2. The cutter according to claim 1, wherein said connecting means is elastically deformable under bending stress and torsional stress.

3. The cutter according to claim 1, wherein said connecting means permits composite movements of said knife with respect to said sliding and translation means.

4. The cutter according to claim 3, wherein said counter-knife is disposed with respect to said knife so that said composite movements permitted said knife are such as to ensure that the operative cooperation between the knife and the counter-knife takes place continuously during rotation of said knife and counter-knife.

5. The cutter according to claim 4, wherein said composite movements result from the combination of torsional and bending deformations of the elastically deformable structure.

6. The cutter according to claim 1, wherein the connecting means includes several metal blades in juxtaposed relation and fastened together.

* * * * *